US010964149B2

(12) United States Patent
Niizuma

(10) Patent No.: US 10,964,149 B2
(45) Date of Patent: Mar. 30, 2021

(54) COIN PROCESSOR

(71) Applicant: FUJI ELECTRIC CO., LTD., Kawasaki (JP)

(72) Inventor: Nobuyuki Niizuma, Yokkaichi (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 248 days.

(21) Appl. No.: 16/043,839

(22) Filed: Jul. 24, 2018

(65) Prior Publication Data

US 2019/0080542 A1 Mar. 14, 2019

(30) Foreign Application Priority Data

Sep. 12, 2017 (JP) ..... JP2017-175172

(51) Int. Cl.

| | |
|---|---|
| ***G07D 3/16*** | (2006.01) |
| ***G07D 3/02*** | (2006.01) |
| ***G07D 1/06*** | (2006.01) |
| ***G07F 1/04*** | (2006.01) |

(52) U.S. Cl.

CPC ..... *G07D 3/16* (2013.01); *G07D 1/06* (2013.01); *G07D 3/02* (2013.01); *G07F 1/04* (2013.01); *G07D 2201/00* (2013.01)

(58) Field of Classification Search

CPC .. G07D 3/14; G07D 3/16; G07D 3/02; G07D 1/06; G07D 2201/00; G07D 3/10; G07D 5/00; G07D 9/00; G07D 9/002; G07D 9/008; G07D 9/02; G07F 1/00; G07F 1/04; G07F 1/047; G07F 9/04; G07F 9/06; G07F 9/08; G07F 9/10

See application file for complete search history.

(56) References Cited

U.S. PATENT DOCUMENTS

| | | | | |
|---|---|---|---|---|
| 6,029,794 A * | 2/2000 | Tamaki | G07F 17/3248 194/338 |
| 6,383,070 B1 * | 5/2002 | Tamaki | G07D 9/008 194/352 |
| 2004/0093117 A1 * | 5/2004 | Daout | G07D 11/245 700/231 |
| 2007/0000993 A1 * | 1/2007 | Graef | B65H 29/40 235/379 |
| 2007/0029159 A1 * | 2/2007 | Quattrini | G07D 3/14 194/302 |

(Continued)

FOREIGN PATENT DOCUMENTS

| | | | |
|---|---|---|---|
| JP | 2009-238078 A | 10/2009 | |
| JP | 2015-102926 A * | 6/2015 | G07D 9/00 |

OTHER PUBLICATIONS

English Translation of JP2015-102926 A (Year: 2015).*

*Primary Examiner* — Jeffrey A Shapiro
(74) *Attorney, Agent, or Firm* — Manabu Kanesaka

(57) ABSTRACT

This coin processor includes a sorting portion sorting coins, a coin container containing coins, a first coin outlet employed at least for discharging coins for refund payment, a second coin outlet employed at least for discharging coins for change, and a control portion discharging coins of a prescribed type reaching at least a prescribed number substantially filling up the coin container from the coin container to one of the first coin outlet and the second coin outlet when the number of coins of the prescribed type contained in the coin container reaches at least the prescribed number.

14 Claims, 7 Drawing Sheets

MODIFICATION

(56) References Cited

U.S. PATENT DOCUMENTS

| | | | | |
|---|---|---|---|---|
| 2007/0254582 | A1* | 11/2007 | Sato | G07D 1/04 453/57 |
| 2009/0018695 | A1* | 1/2009 | Kronenberg | G06Q 10/087 700/241 |
| 2010/0230234 | A1* | 9/2010 | Ishimatsu | G07D 5/02 194/328 |
| 2013/0035024 | A1* | 2/2013 | Okawa | 453/18 |
| 2013/0052926 | A1* | 2/2013 | Taniike | G07D 3/16 453/58 |
| 2017/0206726 | A1* | 7/2017 | Sato | G07D 5/02 |
| 2018/0268666 | A1* | 9/2018 | Takata | G06Q 20/18 |

* cited by examiner

FIRST EMBODIMENT

FLOW OF COIN DISCHARGE PROCESSING PER TYPE (SUBROUTINE OF STEP S7)

SECOND EMBODIMENT

MODIFICATION

COIN PROCESSOR

CROSS-REFERENCE TO RELATED APPLICATION

The present application claims priority of Japanese Patent Application number JP2017-175172, Coin Processor, filed Sep. 12, 2017, Nobuyuki Niizuma, is hereby incorporated by reference.

BACKGROUND OF THE INVENTION

Field of the Invention

The present invention relates to a coin processor, and more particularly, it relates to a coin processor including a coin container containing coins per type.

Description of the Background Art

A coin processor including a coin container containing coins per type is known in general, as disclosed in Japanese Patent Laying-Open No. 2009-238078.

Japanese Patent Laying-Open No. 2009-238078 discloses a coin processor including a sorting portion sorting coins per type, a coin container containing the coins sorted by the sorting portion per type, a dispensing port discharging coins for change, a refunding port discharging coins for refund payment, a coin recovery box and a switching gate. The coin processor is configured to deliver coins in a number reaching at least a prescribed number substantially filling up the coin container from the coin container to the dispensing port when the coins reach at least the prescribed number. The coin processor is also configured to perform overflow control of switching a coin conveyance destination path from the dispensing port to the coin recovery box by switching the switching gate provided in front of the dispensing port thereby discharging (storing) the coins in the coin recovery box.

However, the coin processor described in Japanese Patent Laying-Open No. 2009-238078 includes the dedicated coin recovery box and the dedicated switching gate for switching the coin conveyance destination path to the coin recovery box in front of the dispensing port as the structure for discharging coins when performing the overflow control. Therefore, the device structure is disadvantageously complicated.

SUMMARY OF THE INVENTION

The present invention has been proposed in order to solve the aforementioned problem, and an object of the present invention is to provide a coin processor capable of performing overflow control with an existing structure without complicating the device structure.

In order to attain the aforementioned object, a coin processor according to one aspect of the present invention includes a sorting portion sorting coins received from a coin inlet per type, a coin container containing the coins sorted by the sorting portion per type, a first coin outlet employable at least for discharging coins for refund payment, a second coin outlet employable at least for discharging coins for change and a control portion performing overflow control of discharging coins of a prescribed type reaching at least a prescribed number substantially filling up the coin container from the coin container to one of the first coin outlet and the second coin outlet when the number of the coins of the prescribed type contained in the coin container reaches at least the prescribed number.

The aforementioned coin processor according to this aspect is so provided with the aforementioned control portion that the same can controllingly discharge coins reaching at least the prescribed number substantially filling up the coin container to one of the existing first coin outlet employable for discharging coins for refund payment and the existing second coin outlet employable for discharging coins for change. Consequently, the coin processor can perform the overflow control with the existing structure without complicating the device structure, dissimilarly to a case of providing a dedicated structure for the overflow control.

In the aforementioned coin processor according to this aspect, the control portion is preferably configured to perform the overflow control of discharging the coins of the type reaching at least the prescribed number from the coin container to one of the first coin outlet and the second coin outlet and to perform control of discharging coins for refund payment and coins for change to the other one of the first coin outlet and the second coin outlet. According to this structure, coins discharged through the overflow control and those for refund payment and for change are discharged to coin outlets different from each other, whereby the coins can be prevented from mixing with each other. Consequently, labor for removing coins for refund payment or for change from the coin outlet before performing the overflow control can be omitted. Further, labor for removing coins discharged through the overflow control from the coin outlet can be omitted before discharging those for refund payment and for change.

The aforementioned coin processor according to this aspect preferably further includes a discharged coin counting sensor counting the number of coins discharged to one of the first coin outlet and the second coin outlet, and the control portion is preferably configured to perform control of managing a total number of discharged coins indicating the sum of the number of coins discharged to one of the first coin outlet and the second coin outlet every overflow control on the basis of the number of coins delivered from the coin container and the number of discharged coins counted by the discharged coin counting sensor when performing the overflow control. The total number of discharged coins, indicating the total number of coins stored in one of the first and second coin outlets through the overflow control, is calculated by adding up the numbers of coins discharged to one of the first and second coin outlets every overflow control. For example, it is assumed that the coin processor is configured to discharge coins to the first coin outlet through the overflow control and the number of coins stored in the first coin outlet is zero. When the numbers of coins discharged through the first overflow control and the second overflow control are 10 and 20 respectively, the total number of discharged coins (the number of coins stored in the first coin outlet) is 30. According to the aforementioned structure, the coin processor can prevent one of the first and second coin outlets from being filled up (or overflown) with discharged coins on the basis of the total number of discharged coins and the maximum number (capacity) of coins containable in one of the existing first and second coin outlets.

In this case, the coin processor preferably further includes a delivered coin counting sensor counting the number of coins delivered from the coin container per type, while the control portion is preferably configured to perform control of delivering coins of the type reaching at least the prescribed number from the coin container per type when performing the overflow control and to perform control of subtracting one from the number of coins of the delivered type contained in the coin container and adding one to the total number of coins discharged to one of the first coin outlet and the second coin outlet while confirming whether or not the total number of delivered coins counted by the delivered coin counting sensor and the total number of discharged coins counted by the discharged coin counting sensor coincide with each other every time the discharged coin counting sensor counts a single coin. The total number of delivered coins indicates the total number of coins delivered from the coin container through single overflow control, and the total number of discharged coins indicates the total number of coins discharged to one of the first and second coin outlets through single overflow control. According to the aforementioned structure, the discharged coin counting sensor can count coins of a single type one by one, whereby the control portion can more correctly perform the overflow control. Further, the control portion can secure precision (correctness) of the total number of delivered coins and the total number of discharged coins by confirming the coincidence therebetween.

In the aforementioned structure having the control portion managing the total number of coins discharged to one of the first coin outlet and the second coin outlet, the coin processor preferably further includes a delivered coin counting sensor counting the number of coins delivered from the coin container per type, while the control portion is preferably configured to perform control of collectively delivering coins of a plurality of types reaching at least the prescribed number from the coin container to one of the first coin outlet and the second coin outlet if the plurality of types of coins reaches at least the prescribed number when performing the overflow control, and to perform control of collectively decreasing the number of coins of the delivered types contained in the coin container and collectively increasing the total number of coins discharged to one of the first coin outlet and the second coin outlet when the total number of delivered coins counted by the delivered coin counting sensor and the total number of discharged coins counted by the delivered coin counting sensor coincide with each other. According to this structure, the numbers of coins of a plurality of types can be collectively counted, whereby the control portion can more quickly perform the overflow control. Further, the control portion can secure precision (correctness) of the total number of delivered coins and the total number of discharged coins by determining the coincidence therebetween.

In the aforementioned structure having the control portion decreasing the number of coins of the delivered types contained in the coin container and increasing the total number of coins discharged to one of the first coin outlet and the second coin outlet, the coin processor preferably further includes a residual coin sensor sensing the presence or absence of coins remaining in one of the first coin outlet and the second coin outlet receiving the coins of the type reaching at least the prescribed number, for resetting the total number of discharged coins discharged to one of the first coin outlet and the second coin outlet and counted by the discharged coin counting sensor to zero when the residual coin sensor senses the absence of coins remaining in one of the first coin outlet and the second coin outlet. According to this structure, the coin processor can reset the total number of discharged coins counted by the discharged coin counting sensor to zero with the residual coin sensor, whereby the coin processor can correctly manage the total number of discharged coins also when the coins discharged to (stored in) the first coin outlet are removed.

In the aforementioned coin processor according to this aspect, the control portion is preferably configured to perform control of discharging coins in a number exceeding the upper limit for the number of coins of the prescribed type containable in the coin container to the other one of the first coin outlet and the second coin outlet without through the coin container when receiving coins in excess of the upper limit. According to this structure, the coins in the number exceeding the upper limit can be discharged to one of the first and second coin outlets without through the coin container, whereby the coin processor can avoid an error caused by receiving coins in a number uncontainable in the coin container.

The aforementioned coin processor according to this aspect preferably further includes a mountable lid portion on one of the first coin outlet and the second coin outlet receiving the coins of the type reaching at least the prescribed number. According to this structure, the coin processor can prevent a person other than the one having prescribed authority from extracting the coins discharged through the overflow control by mounting the lid portion. Further, the lid portion can prevent coins from overflowing one of the first and second coin outlets and falling out of the coin processor.

In this case, the lid portion is preferably configured to be closed in a use state where a customer makes account and to be opened or demounted in a use state where a distributor makes account. According to this structure, the coin processor can prevent a person other than the one having prescribed authority from extracting coins in the use state (so-called self accounting state) where the customer makes account. Further, the distributor can easily extract coins from one of the first and second coin outlets by demounting (or opening) the lid portion in the use state where the distributor makes account.

The aforementioned coin processor according to this aspect preferably further includes a coin checking portion determining the type of coins received in the coin inlet and whether or not the coins are in specie, while the control portion is preferably configured to perform control of discharging coins determined by the coin checking portion as not in specie to the other one of the first coin outlet and the second coin outlet if the coin checking portion determines that the received coins are not in specie when performing the overflow control of discharging coins of the type reaching at least the prescribed number from the coin container to one of the first coin outlet and the second coin outlet. According to this structure, the control portion can discharge coins (medium) not in specie to the other one of the first and second coin outlets, whereby the same can prevent the coins (medium) not in specie and those discharged through the overflow control from mixing with each other.

The aforementioned coin processor according to this aspect preferably further includes a temporary holding portion temporarily holding coins received from the coin inlet and conveying the coins to the sorting portion or the first coin outlet, a contained coin switching gate provided on the temporary holding portion for switching coin conveyance destination path to either the sorting portion or the first coin outlet, a paid coin conveying portion conveying coins delivered from the coin container to the second coin outlet or the temporary holding portion and a paid coin switching gate provided on the paid coin conveying portion for switching a coin conveyance destination path to either the second coin outlet or the temporary holding portion, while the control portion is preferably configured to perform control of switching the coin conveyance destination path to the temporary holding portion with the paid coin switching gate, switching the coin conveyance destination path to the first coin outlet with the contained coin switching gate and discharging the coins of the type reaching at least the prescribed number from the coin container to the first coin outlet through the paid coin conveying portion and the temporary holding portion when performing the overflow control. According to this structure, the coin processor can ensure the conveying path for the coins discharged through the overflow control with the temporary holding portion, the contained coin switching gate, the paid coin conveying portion and the paid coin switching gate. Further, the coin processor can convert the existing contained coin switching gate and the existing temporary holding portion employed for introducing coins into the coin container as well as the existing paid coin conveying portion and the existing paid coin switching gate employed for delivering coins from the coin container as the conveying path for coins discharged through the overflow control, whereby the device structure can be prevented from complication.

The aforementioned coin processor according to this aspect preferably further includes an openable/closable introduction gate having an introduction hole and configured to be mountable on the lower end of the first coin outlet and a box-type reservation portion configured to be mountable on the first coin outlet from below the introduction gate for receiving coins of the type reaching at least the prescribed number and reserving the coins therein through the first coin outlet and the introduction hole when the introduction gate is in an open state, while the control portion is preferably configured to perform control of discharging coins for refund payment to the first coin outlet in a state where the introduction gate is closed while discharging coins of the type reaching at least the prescribed number into the reservation portion through the first coin outlet and reserving the coins in the reservation portion in a state where the introduction gate is opened. According to this structure, the reservation portion can reserve a larger number of coins on the side of the first coin outlet. Further, the control portion can prevent coins for refund payment and those discharged through the overflow control from mixing with each other by opening/closing the introduction gate.

DESCRIPTION OF THE PREFERRED EMBODIMENTS

Embodiments of the present invention are now described with reference to the drawings.

First Embodiment (Overall Structure of Coin Processor)

The overall structure of a coin processor (change machine) 100 according to a first embodiment of the present invention is described with reference to FIGS. 1 and 2.

Figure 1:
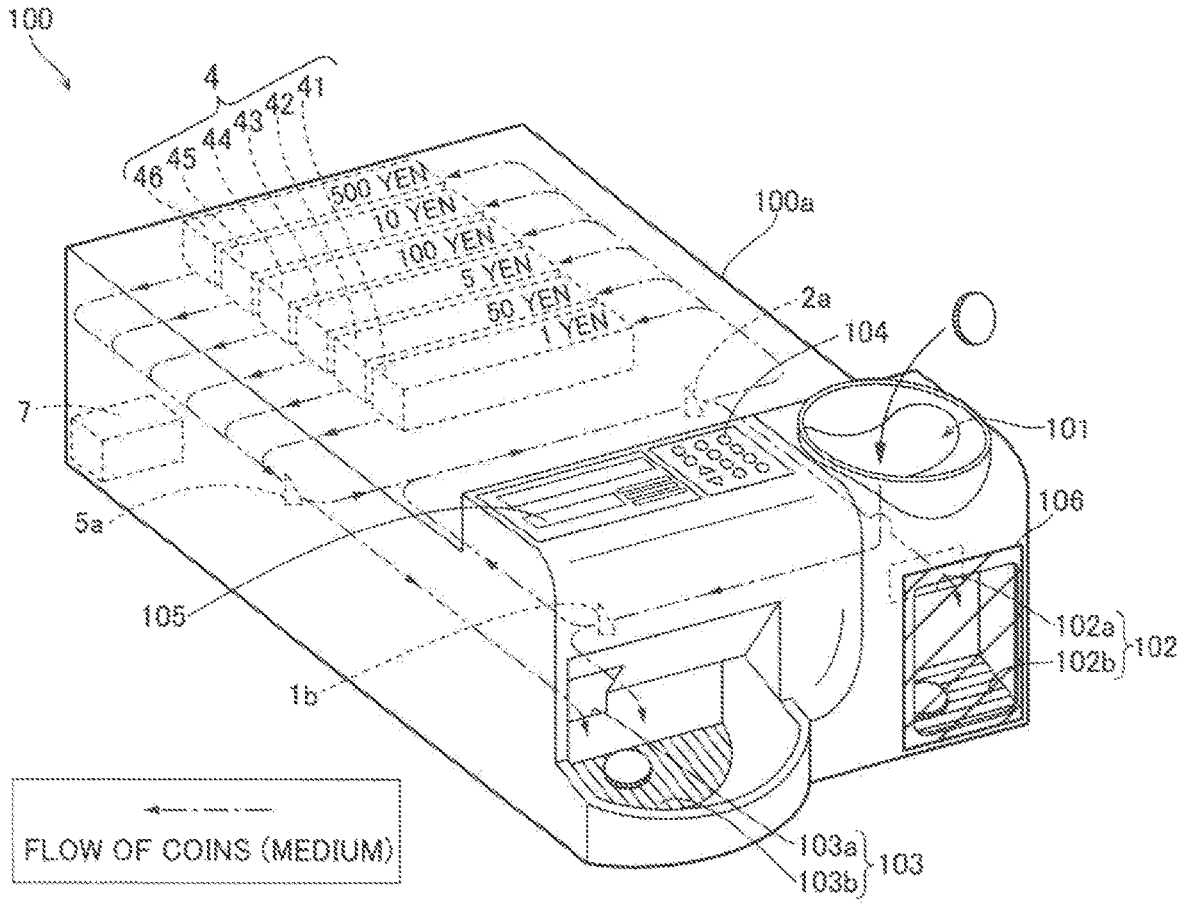
FIG. 1 is a perspective view showing a coin processor according to a first embodiment of the present invention.

The coin processor 100 according to the first embodiment of the present invention shown in FIG. 1 is configured to be connectable to a POS (Point-Of-Sale System) register, a bill processor or a coin roll container (not shown), and set in a store such as a supermarket or a convenience store for constructing part of a POS. The coin processor 100 is employed in a use state (self-use state) where a customer makes account him/herself or a use state where a distributor (supervisor) makes account.

The coin processor 100 includes a box-type housing 100*a*. The housing 100*a* is provided with a coin inlet 101, a first coin outlet 102, a second coin outlet 103, an operation portion 104 and a display portion 105.

Figure 2:
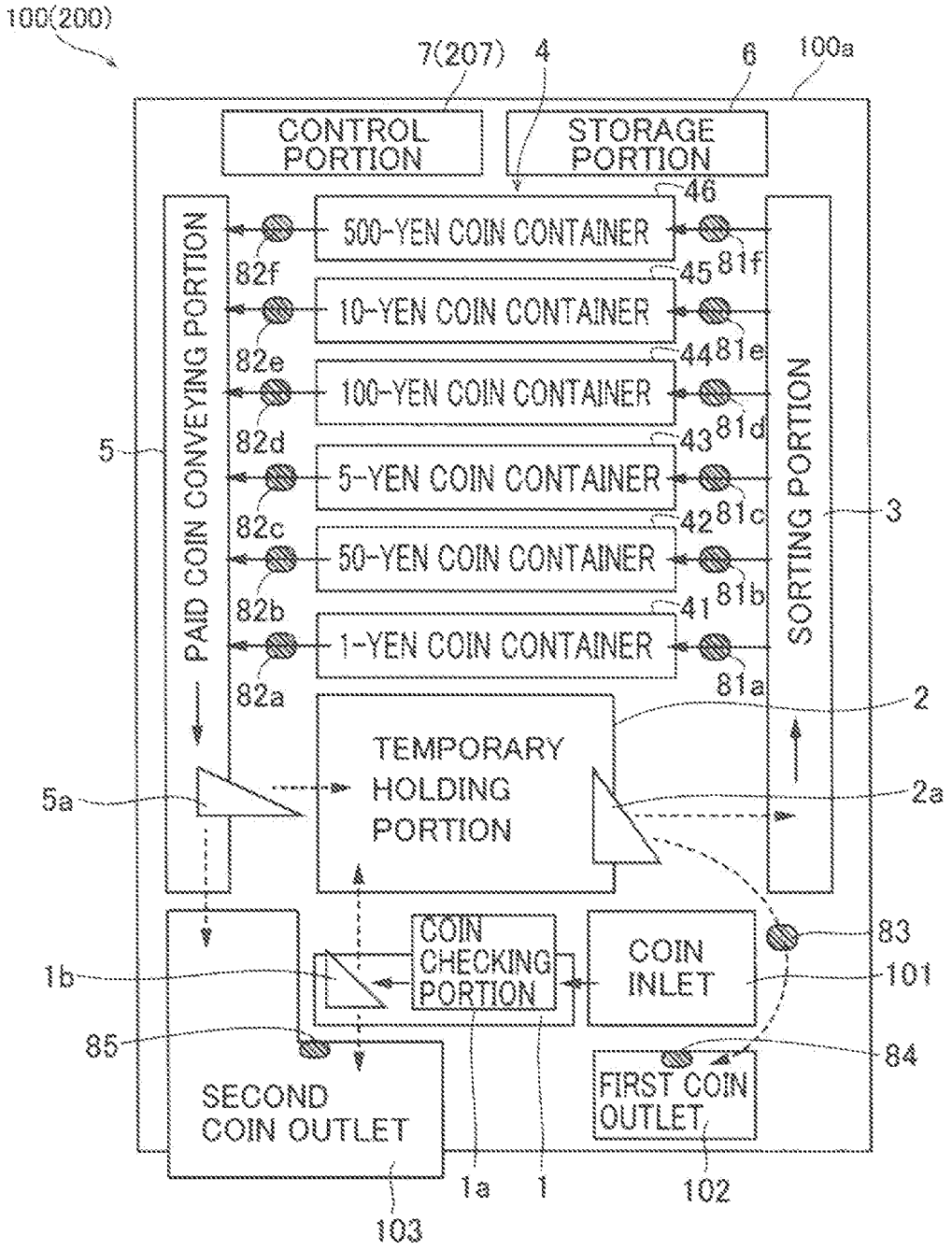
FIG. 2 is a diagram for illustrating the structure and functions of the coin processor according to the first embodiment of the present invention.

As shown in FIG. 2, the coin processor 100 further includes a received coin conveying portion 1, a coin checking portion 1*a*, a received coin switching gate 1*b*, a temporary holding portion 2, a contained coin switching gate 2*a*, a sorting portion 3, a coin container 4, a paid coin conveying portion 5, a paid coin switching gate 5*a*, a storage portion 6 and a control portion 7. The coin container 4 includes a 1-yen coin container 41 containing 1-yen coins, a 50-yen coin container 42 containing 50-yen coins, a 5-yen coin container 43 containing 5-yen coins, a 100-yen coin container 44 containing 100-yen coins, a 10-yen coin container 45 containing 10-yen coins and a 500-yen coin container 46 containing 500-yen coins.

According to the first embodiment, the control portion 7 of the coin processor 100 is configured to perform overflow control of discharging coins of a prescribed type from the coin container 4 to the first coin outlet 102 in a case where the contained coins reach at least a prescribed number substantially filling up the coin container 4. In other words, the coin processor 100 is configured to ensure a sufficient space in the coin container 4 by performing the overflow control, in order to prevent the coin container 4 from being filled up. The overflow control is described later in detail.

The coin processor 100 further includes six sorted coin counting sensors 81*a*, 81*b*, 81*c*, 81*d*, 81*e* and 81*f*, six delivered coin counting sensors 82*a*, 82*b*, 82*c*, 82*d*, 82*e* and 82*f*, a discharged coin counting sensor 83 and residual coin sensors 84 and 85.

(Structures of Respective Portions of Coin Processor)

As shown in FIG. 1, the coin inlet 101 is an inlet portion for introducing coins into the coin processor 100. The coin inlet 101 is configured to be capable of simultaneously receiving a plurality of coins.

The first and second coin outlets 102 and 103 are outlet portions for discharging coins from the coin processor 100 respectively. The first coin outlet 102 includes an opening 102*a* for discharging coins from the housing 100*a* and a tray portion 102*b* for receiving and storing discharged coins. Similarly, the second coin outlet 103 includes an opening 103*a* for discharging coins from the housing 100*a* and a tray portion 103*b* for receiving and storing discharged coins.

The first coin outlet 102 is employed when the control portion 7 performs overflow control of discharging coins of a prescribed type from the coin container 4 in a case where the contained coins reach at least a prescribed number substantially (or actually) filling up the coin container 4. The first coin outlet 102 is provided with a lid portion 106 (see a hatched portion in FIG. 1) mountable thereon. The lid portion 106 is provided with a key or the like, and configured to be openable/closable only by a specific person such as a distributor.

The case where the contained coins reach at least the prescribed number substantially (or actually) filling up the coin container 4 corresponds to a case where the coin container 4 reaches the so-called full state (where the number of coins of any prescribed type contained in the coin container 4 (any of 41 to 46) reaches the upper limit) or a near-full state (where the number of coins of the prescribed type contained in the coin container 4 approaches the upper limit).

The second coin outlet 103 is employed for discharging coins for change, a medium not in specie and coins for refund payment. The coins for change and those for refund payment are delivered from the coin container 4.

The coins for change correspond to coins in an amount obtained by subtracting the price of a purchased item from the sum of money received in the coin processor 100. The coins for refund payment correspond to coins to be refunded to the customer when he/she cancels the purchase before the adjustment.

The second coin outlet 103 is employed for discharging coins in a number exceeding the upper limit (full state) of the coin container 4 when the coin inlet 101 receives an excessive number of coins. In this case, the coins received in the coin inlet 101 themselves are refunded to the customer without delivering different coins of the equivalent amount from the coin container 4. When the coins in the number exceeding the upper limit are refunded from the second coin outlet 103, the received amount may be insufficient for the price of the purchased item. In this case, coins of the insufficient amount must be introduced into the coin inlet 101 after the overflow control or with coins of a different type.

More specifically, it is assumed that the 100-yen coin container 44 is capable of receiving nine more coins, for example. It is also assumed that the customer purchases an item costing 1000 yen and he/she introduces ten 100-yen coins into the coin inlet 101. In this case, the coin processor 100 discharges one 100-yen coin from the second coin outlet 103 as that exceeding the upper limit (full state) of the 100-yen coin container 44. Consequently, the paid amount is less than (insufficient for) the cost for the item. Therefore, the customer must pay for this amount with coins of a type different from 100 yen, or must introduce the coin after the overflow control. When the coin processor 100 refunds coins in a number exceeding the upper limit (full state) of the coin container 4, the received coin switching gate 1*b* switches the conveyance destination path for the medium (coins) received from the coin inlet 101 to the second coin outlet 103. This operation is described later in detail.

The operation portion 104 has a plurality of buttons accepting various types of operations on the coin processor 103. The display portion 105 is configured to display various types of error codes and the like.

As shown in FIG. 2, the received coin conveying portion 1 is configured to convey coins received from the coin inlet 101 to the temporary holding portion 2 or the second coin outlet 103. For example, the received coin conveying portion 1 has a belt mechanism as a mechanism for conveying coins.

The coin checking portion (distinguishing portion) la is provided on the received coin conveying portion 1. The coin checking portion 1*a* is configured to check the type of the coins received in the coin inlet 101 and to determine whether or not the coins are in specie (according to this embodiment, whether or not the coins are 1-yen coins, 5-yen coins, 10-yen coins, 50-yen coins, 100-yen coins and/or 500-yen coins). Further, the coin checking portion 1*a* is configured to be capable of counting the number of the coins received in the coin inlet 101 per type.

The received coin switching gate 1*b* is provided on a coin outlet portion of the received coin conveying portion 1 on a downstream side of the coin checking portion 1*a*. The received coin switching gate 1*b* is configured to switch the conveyance destination path for the medium (coins) received from the coin inlet 101 to either the temporary holding portion 2 or the second coin outlet 103.

In detail, the received coin switching gate 1*b* is configured to switch the coin conveyance destination path for conveying (discharging) the medium to the second coin outlet 103 when the coin checking portion 1*a* determines that the medium is not in specie. Further, the received coin switching gate 1*b* is configured to switch the coin conveyance destination path for conveying the coins to the temporary holding portion 2 when the coin checking portion 1*a* determines that the medium is in specie.

The temporary holding portion 2 is configured to temporary hold the coins received from the coin inlet 101. Further, the temporary holding portion 2 is configured to convey the temporarily held coins to the sorting portion 3 or the first coin outlet 102. For example, the temporary holding portion 2 has a belt mechanism as a mechanism for conveying the coins.

The contained coin switching gate 2*a* is provided on a coin outlet portion of the temporary holding portion 2. The contained coin switching gate 2*a* is configured to switch the conveyance destination path for the temporarily held coins to either the sorting portion 3 or the first coin outlet 102.

The temporary holding portion 2 is configured to be capable of receiving coins from the paid coin conveying portion 5 conveying coins delivered from the coin container 4 through switching by the paid coin switching gate 5*a*. Further, the temporary holding portion 2 functions as a conveying path for conveying coins to the first coin outlet 102 when the control portion 7 performs the overflow control. Therefore, the control portion 7 vacates the temporary holding portion 2 when performing the overflow control.

The sorting portion 3 is configured to convey coins to the coin container 4. For example, the sorting portion 3 has a belt mechanism as a mechanism for conveying coins.

The sorting portion 3 is configured to sort coins to the 1-yen coin container 41, the 50-yen coin container 42, the 5-yen coin container 43, the 100-yen coin container 44, the 10-yen coin container 45 and the 500-yen coin container 46 in response to the types thereof in the process of conveying the coins. For example, the sorting portion 3 is configured to sort the coins per type by separating the coins from each other on the conveying path through the differences between the sizes of the coins.

The 1-yen coin container 41, the 50-yen coin container 42, the 5-yen coin container 43, the 100-yen coin container 44, the 10-yen coin container 45 and the 500-yen coin container 46 are configured to contain coins of prescribed single types different from each other respectively. The control portion 7 manages the number of coins contained in the coin container 4 (41 to 46) with various types of sensors. Further, the 1-yen coin container 41, the 50-yen coin container 42, the 5-yen coin container 43, the 100-yen coin container 44, the 10-yen coin container 45 and the 500-yen coin container 46 are configured to temporarily deliver (send out) coins of the respective types to the paid coin conveying portion 5 at the time of payment or the like. For example, the coin containers 41 to 46 have belt mechanisms as mechanisms for delivering the coins respectively.

The paid coin conveying portion 5 is configured to convey the coins delivered from the coin container 4 to the first coin outlet 102 or the temporary holding portion 2. For example, the paid coin conveying portion 5 has a belt mechanism as a mechanism for conveying the coins.

The paid coin switching gate 5*a* is provided on a coin outlet portion of the paid coin conveying portion 5. The paid coin switching gate 5*a* is configured to switch the conveyance destination path for the coins delivered from the coin container 4 to either the temporary holding portion 2 or the second coin outlet 103.

The sorted coin counting sensors 81*a* to 81*f* are provided on the sorting portion 3. Further, the sorted coin counting sensors 81*a* to 81*f* are provided in the vicinity of coin inlet portions of the 1-yen coin container 41, the 50-yen coin container 42, the 5-yen coin container 43, the 100-yen coin container 44, the 10-yen coin container 45 and the 500-yen coin container 46 respectively. The sorted coin counting sensors 81*a* to 81*f* are configured to count the numbers of coins sorted to the coin containers 41 to 46 in response to the types thereof.

The sorted coin counting sensors 81*a* to 81*f* may be formed by sensors of any type such as transmission type photo sensors, reflection type photo sensors, coil type sensors or the like, so far as the same can count the numbers of the sorted coins.

The delivered coin counting sensors 82*a* to 82*f* are provided on the paid coin conveying portion 5. Further, the delivered coin counting sensors 82*a* to 82*f* are provided in the vicinity of coin outlet portions of the 1-yen coin container 41, the 50-yen coin container 42, the 5-yen coin container 43, the 100-yen coin container 44, the 10-yen coin container 45 and the 500-yen coin container 46 respectively. The delivered coin counting sensors 82*a* to 82*f* are configured to count the numbers of coins delivered from the coin containers 41 to 46 in response to the types thereof.

The delivered coin counting sensors 82*a* to 82*f* may be formed by sensors of any type such as transmission type photo sensors, reflection type photo sensors, coil type sensors or the like, so far as the same can count the numbers of the delivered coins.

The discharged coin counting sensor 83 is provided between the temporary holding portion 2 and the first coin outlet 102. In other words, the discharged coin counting sensor 83 is provided in the middle of a coin conveying path connecting the contained coin switching gate 2*a* and the first coin outlet 102 when the contained coin switching gate 2*a* switches the path for conveying the coins to the first coin outlet 102. The discharged coin counting sensor 83 is configured to count the number of coins discharged to the first coin outlet 102. The discharged coin counting sensor 83 counts the number of coins discharged to the first coin outlet 102 every time the control portion 7 performs the overflow control. The discharged coin counting sensor 83 is a sensor simply recognizing passage of coins and counting the number thereof regardless of the type of the coins.

The discharged coin counting sensor 83 may be formed by a sensor of any type such as a transmission type photo sensor, a reflection type photo sensor, a coil type sensor or the like, so far as the same can count the number of discharged coins.

The residual coin sensor 84 is provided on the first coin outlet 102. The residual coin sensor 84 is configured to sense the presence or absence of coins remaining in the first coin outlet 102. The residual coin sensor 84 may simply have a function of sensing the presence or absence of coins, and may not be capable of determining the types and numbers of the coins.

The residual coin sensor 84 may be formed by a sensor of any type such as a transmission type photo sensor, a reflection type photo sensor, a coil type sensor or the like, so far as the same can sense the presence or absence of coins.

The residual coin sensor 85 is provided on the second coin outlet 103. The residual coin sensor 85 is configured to sense the presence or absence of coins remaining in the second coin outlet 103. The residual coin sensor 85 may simply have a function of sensing the presence or absence of coins, and may not be capable of determining the types and numbers of the coins.

The residual coin sensor 85 may be formed by a sensor of any type such as a transmission type photo sensor, a reflection type photo sensor, a coil type sensor or the like, so far as the same can sense the presence or absence of coins.

Figure 3:
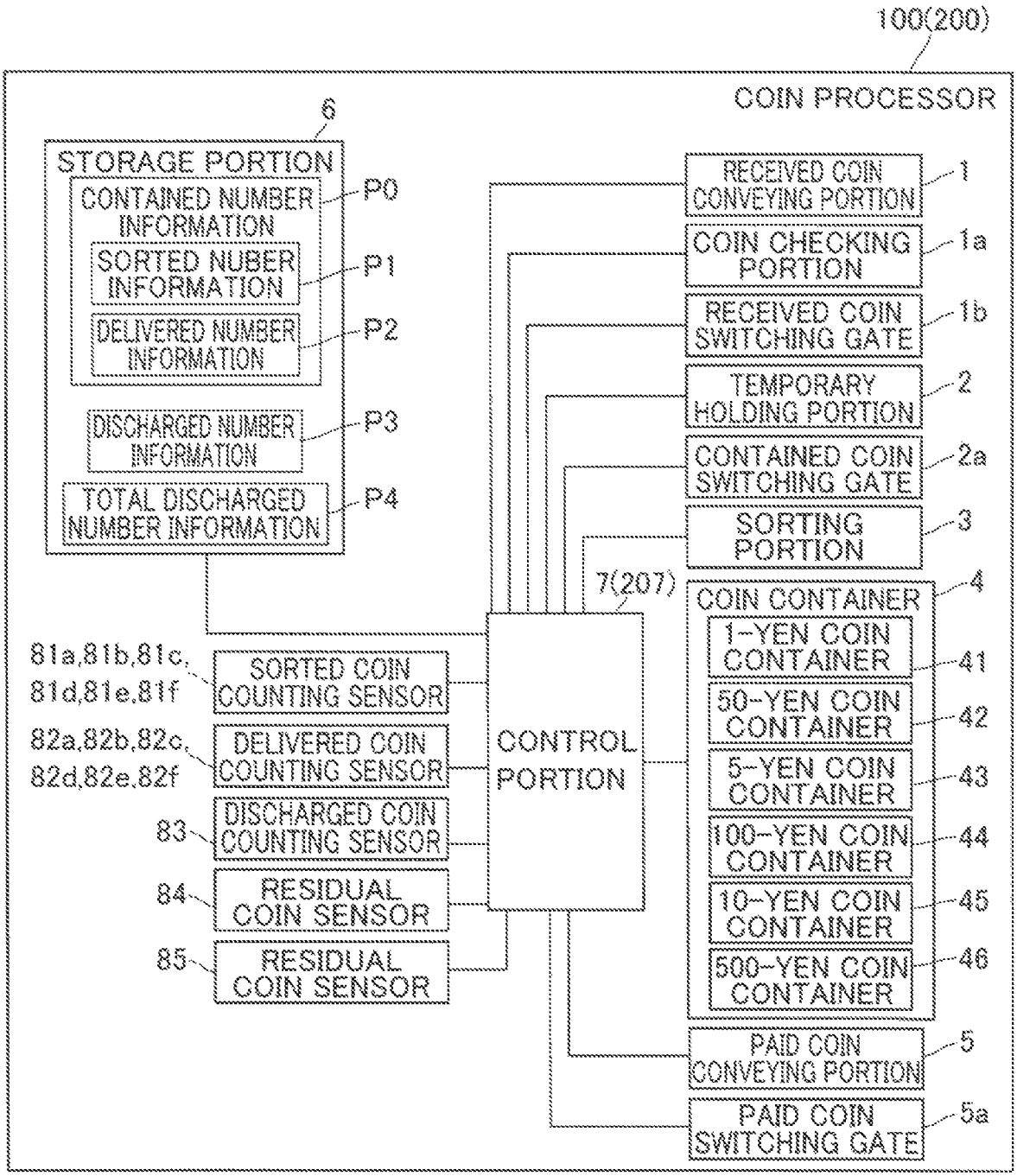
FIG. 3 is a block diagram of the coin processor according to the first embodiment of the present invention.

As shown in FIG. 3, the storage portion 6 is configured to store contained number information P0 on the numbers of coins contained in the coin containers 41 to 46, sorted number information P1 on numbers of sorted coins counted by the sorted coin counting sensors 81*a* to 81*f*, delivered number information P2 on numbers of delivered coins counted by the delivered coin counting sensors 82*a* to 82*f*, discharged number information P3 on numbers of discharged coins counted by the discharged coin counting sensor 83 and total discharge number information P4 indicating the total number of coins discharged to the first coin outlet 102 (the total number of coins stored in the first coin outlet 102).

The total number of discharged coins, indicating the total number of coins stored in the first coin outlet 102, is calculated by adding up the numbers of coins discharged to the first coin outlet 102 every overflow control.

The control portion 7 can calculate the number of coins (contained number information P0) contained in each container 4 (each of 41 to 46) from the sorted number information P1 and the delivered number information P2 immediately after delivery of the coins. However, the control portion 7 is configured to perform control of calculating the number of coins contained in each container 4 (each of 41 to 46) after comparing the delivered number information P2 and the discharged number information P3 with each other (after matching the total number of delivered coins and the total number of discharged coins) when performing the overflow control. This is because coins discharged to the first coin outlet 102 do not belong to the coin processor 100 (not returnable to the coin container 4 through a function of the coin processor 100) and hence the number of discharged coins and the number of coins contained in the coin container 4 are preferably matched with each other.

The total number of delivered coins indicates the total number of coins delivered from the coin container 4 through single overflow control. The total number of discharged coins indicates the total number of coins discharged to the first coin outlet 102 through single overflow control.

(Structure of Control Portion)

The control portion 7 shown in FIG. 3 includes a CPU and a memory, and is configured to control driving of the respective portions of the coin processor 100.

Further, the control portion 7 is configured to manage the number of coins stored in each container 4 (each of 41 to 46) and the total number of coins discharged to the first coin outlet 102.

In addition, the control portion 7 is configured to perform the overflow control of discharging coins of the type reaching at least the prescribed number from the coin container 4 to the first coin outlet 102.

More specifically, the control portion 7 is configured to perform control of switching the coin conveyance destination path to the temporary holding portion 2 with the paid coin switching gate 5*a*, switching the coin conveyance destination path to the first coin outlet 102 with the contained coin switching gate 2*a* and discharging coins of the type reaching at least the prescribed number from the coin container 4 to the first coin outlet 102 through the paid coin conveying portion 5 and the temporary holding portion 2 when performing the overflow control. The overflow control is described in detail along with a processing flow described later.

The control portion 7 is configured to perform control of delivering coins for refund payment and those for change from the coin container 4 and discharging the same to the second coin outlet 103. In other words, the control portion 7 performs control of discharging coins for refund payment and those for change to the outlet different from the first coin outlet 102 discharging coins through the overflow control.

More specifically, the control portion 7 performs control of switching the conveyance destination path for coins delivered from the coin container 4 to the second coin outlet 103 with the paid coin switching gate 5*a* and delivering coins for refund payment or those for change from the coin container 4. When refunding coins from the coin container 4, the control portion 7 performs control of introducing received coins into the coin container 4.

The control portion 7 is configured to perform control of discharging coins (medium) determined as not in specie to the second coin outlet 103 when performing the overflow control of discharging the coins of the type reaching at least the prescribed number from the coin container 4 to the first coin outlet 102, if the coin checking portion 1*a* determines that received coins are not in specie. In other words, the control portion 7 performs control of discharging the coins (medium) determined as not in specie to the outlet different from the first coin outlet 102 discharging the coins through the overflow control.

More specifically, the control portion 7 performs control of switching the conveyance destination path for the coins (medium) received from the coin inlet 101 to the second coin outlet 103 with the received coin switching gate 1*b*, conveying the coins (medium) determined as not in specie with the received coin conveying portion 1 and directly discharging the same to the second coin outlet 103.

The control portion 7 is configured to perform control of directly discharging coins in a number exceeding the upper limit to the second coin outlet 103 with the received coin conveying portion 1 and the received coin switching gate 1*b* without through the coin container 4 when receiving coins of a number exceeding the upper limit for the number of coins of the prescribed type containable in the coin container 4. In other words, the control portion 7 performs control of discharging the coins in the number exceeding the upper limit for the number of coins of the prescribed type containable in the coin container 4 to the outlet different from the first coin outlet 102 discharging coins through the overflow control.

More specifically, the control portion 7 performs control of conveying coins of the number containable in the coin container 4 to the temporary holding portion 2, thereafter switching the conveyance destination path for the coins received from the coin inlet 101 to the second coin outlet 103 with the received coin switching gate 1*b*, and discharging the coins in the number exceeding the upper limit for the number of coins of the prescribed type containable in the coin container 4 to the second coin outlet 103. This is because the control portion 7 cannot vacate the temporary holding portion 2 when performing the overflow control if the same conveys coins in the number exceeding the upper limit for the number of coins of the prescribed type containable in the coin container 4 to the temporary holding portion 2. In other words, the control portion 4 performs the aforementioned control in order to prevent coins delivered from the coin container 4 through the overflow control and the coins in the number exceeding the upper limit for the number of coins of the prescribed type containable in the coin container 4 from mixing with each other in the temporary holding portion 2.

(Processing Flow of Overflow Control)

Figure 4:
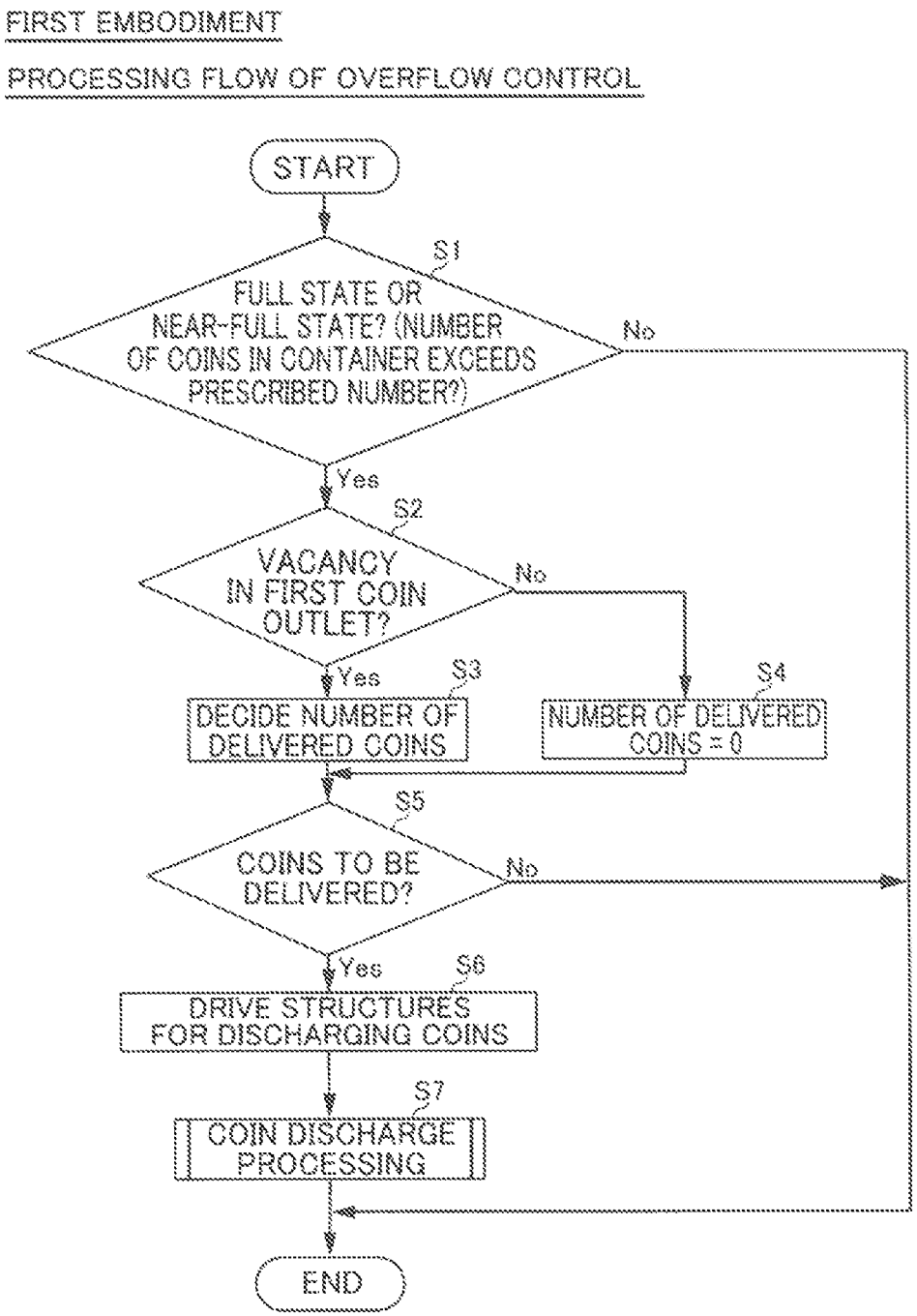
FIG. 4 is a flow chart of overflow control performed by a control portion of the coin processor according to the first embodiment of the present invention.

A processing flow of the overflow control performed in the coin processor 100 according to the first embodiment is now described with reference to FIGS. 4 to 6. The control portion 7 executes the following control processing. The control portion 7 starts the overflow control in a state where the temporary holding portion 2 is vacated through a coin receiving operation or a coin paying operation. As to the reference signs of the respective structures shown below, those shown in FIG. 2 are referred to in principle.

At a step S1, the control portion 7 determines whether or not any of the coin containers 41 to 46 is in a near-full state or a full state (coins contained therein are in a number reaching at least the prescribed number). In other words, the control portion 7 determines whether or not the number of coins of the prescribed type contained in any of the coin containers 41 to 46 reaches at least the prescribed number substantially filling up the coin container 4. Assuming that the maximum number of coins containable in the 1-yen coin container 41 is 150 and a threshold value corresponding to the near-full state is set to 140, the control portion 7 determines that the 1-yen coin container 41 is in the near-full state when the number of coins contained therein exceeds 140. When determining that the number of coins contained in the coin container 4 reaches at least the prescribed number substantially filling up the coin container 4, the control portion 7 advances to a step S2. When determining that the number of coins contained in the coin container 4 is less than the prescribed number, on the other hand, coins may not be discharged from the coin container 4, and hence the control portion 7 terminates the overflow control.

At the step S2, the control portion 7 determines whether or not the first coin outlet 102 has a vacancy (a space for receiving and storing coins). The control portion 7 can grasp the presence or absence of a vacancy in the first coin outlet 102 through the known upper limit for the number of coins containable in the first coin outlet 102 and the contained number information P0 (see FIG. 3) stored in the storage portion 6. The first coin outlet 102 has no vacancy not only in a case where the number of coins contained in the first coin outlet 102 reaches the upper limit (the total number of coins discharged to the first coin outlet 102 reaches the upper limit) but also in a case where the number of coins contained in the first coin outlet 102 substantially reaches the upper limit. When the first coin outlet 102 has no vacancy, the distributor or the like must extract the coins held in the first coin outlet 102. The control portion 7 advances to a step S3 if the first coin outlet 102 has a vacancy, while the same advances to a step S4 if the first coin outlet 102 has no vacancy.

At the step S3, the control portion 7 decides the number of delivered coins every container 4 (41, 42, 43, 44, 45 or 46) (per type). The control portion 7 decides the number of delivered coins so that the number of contained coins reaches a prescribed set number. This set number is previously set with an allowance (of an order allowing a plurality of times of accounting) so that the number of coins in the coin container 4 is less than that bringing the coin container 4 into the near-full state and does not immediately bring the same to the near-full state. More specifically, the control portion 7 decides the number of delivered 1-yen coins to 105 from the difference between the number of coins contained in the coin container 4 in practice and the prescribed set number when the 1-yen coin container 41 contains 145 coins in practice, the threshold value bringing the coin container 4 into the near-full state is at least 140 and the prescribed set number is 40, for example. After deciding the number of delivered coins, the control portion 7 advances to a step S5.

The control portion 7 decides the number of delivered coins to zero at the step S4 since the first coin outlet 102 has no vacancy, and thereafter advances to the step S5.

At the step S5, the control portion 7 determines whether or not there are coins to be delivered. In other words, the control portion 7 determines whether or not the number of delivered coins is at least 1. The control portion 7 advances to a step S6 if there are coins to be delivered, while the same terminates the overflow control if there are no coins to be delivered, since coins may not be delivered from the coin container 4.

At the step S6, the control portion 7 drives respective structures for conveying and discharging coins. In other words, the control portion 7 ensures the conveying path for discharging coins. More specifically, the paid coin switching gate 5*a* switches the coin conveyance destination path to the temporary holding portion 2 when the control portion 7 performs the overflow control. Further, the contained coin switching gate 2*a* switches the coin conveyance destination path to the first coin outlet 102. In addition, the control portion 7 drives mechanisms of the paid coin conveying portion 5 and the temporary holding portion 2 for conveying coins respectively. Then, the control portion 7 advances to a step S7 for performing coin discharge processing.

(Coin Discharge Processing)

Figure 5:
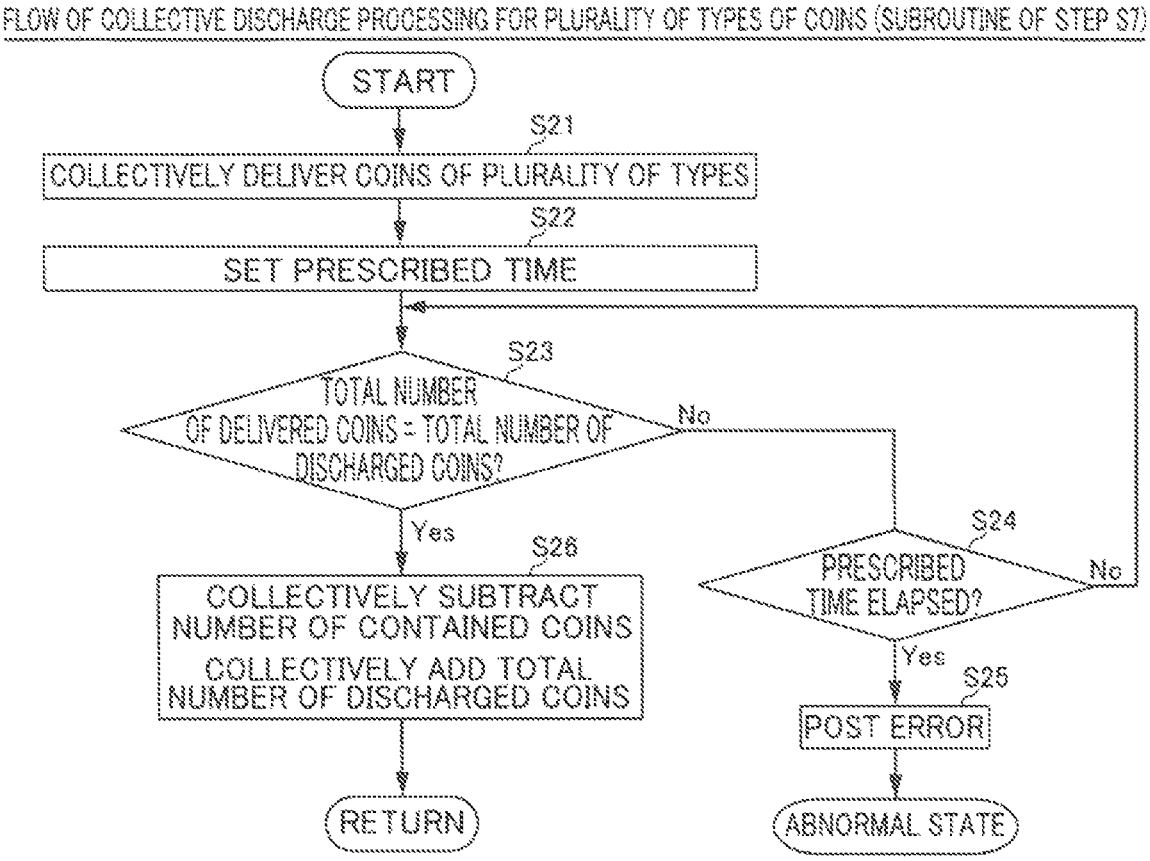
FIG. 5 illustrates a subroutine of coin discharge processing collectively performed for a plurality of types of coins by the control portion of the coin processor according to the first embodiment of the present invention.
Figure 6:
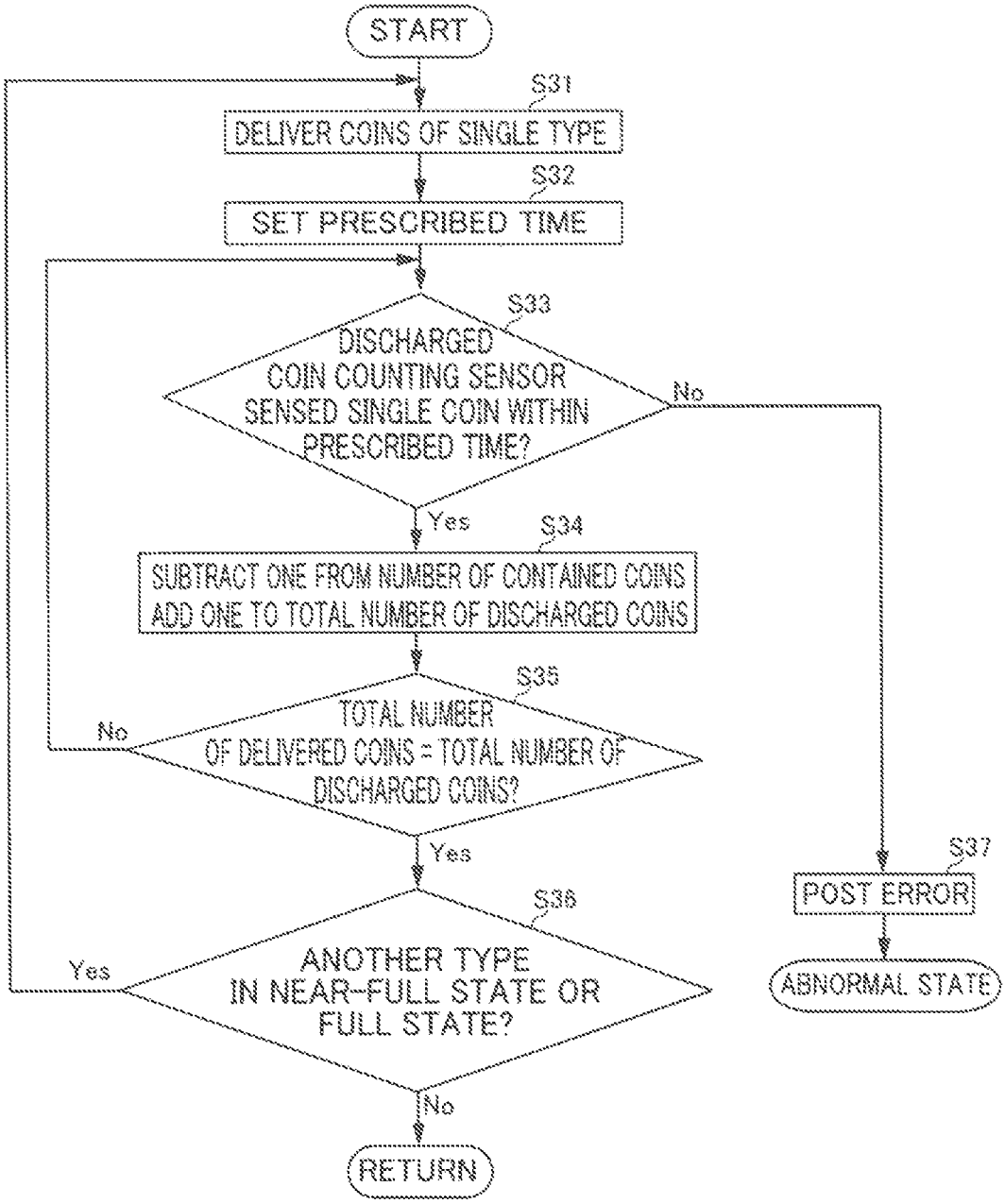
FIG. 6 illustrates a subroutine of another coin discharge processing performed per type of coins by the control portion of the coin processor according to the first embodiment of the present invention.

According to the first embodiment, the control portion 7 has two subroutine modes at the step S7, i.e., a mode of collectively discharging a plurality of types of coins shown in FIG. 5 and a mode of discharging coins per type shown in FIG. 6. The modes are now described in order.

(Collective Discharge Processing for a Plurality of Types)

At a step S21, the control portion 7 controls the coin container 4 (any of 41 to 46) in the near-full states or the full states (containing coins in the numbers reaching at least the prescribed number) to collectively deliver coins of the number decided at the aforementioned step S3, as shown in FIG. 5. More specifically, the 1-yen coin container 41 and the 10-yen coin container 45 simultaneously deliver 1-yen coins and 10-yen coins when the 1-yen and 10-yen coin containers 41 and 45 are both in the near-full states or the full states (containing coins in numbers reaching at least the prescribed number). Then, the control portion 7 advances to a step S22.

At the step S22, the control portion 7 sets a prescribed time required for discharging coins after delivering the same. This prescribed time at least includes a time generally required for delivering coins and discharging all coins to the first coin outlet 102 and an allowance time for vacancy definition of the conveying path. During this prescribed time, the control portion 7 continuously drives the mechanisms of the paid coin conveying portion 5 and the temporary holding portion 2 for conveying coins. After setting the prescribed time, the control portion 7 advances to a step S23. The control portion 7 resets the prescribed time every time the discharged coin counting sensor 83 counts one coin.

At the step S23, the control portion 7 determines whether or not the total number of delivered coins counted by the delivered coin counting sensors 82*a* to 82*f* and the total number of discharged coins counted by the discharged coin counting sensor 83 coincide with each other. In other words, the control portion 7 confirms whether or not all delivered coins have been completely discharged to the first coin outlet 102. The control portion 7 acquires the total number of delivered coins and the total number of discharged coins from the delivered number information P2 and the discharged number information P3 stored in the storage portion 7 respectively. The control portion 7 advances to a step S24 if the total number of delivered coins and the total number of discharged coins do not coincide with each other, while the same advances to a step S26 if these numbers coincide with each other.

At the step S24, the control portion 7 determines whether or not the prescribed time set at the step S22 has elapsed. The control portion 7 returns to the step S23 if the prescribed time has not yet lapsed, while the same advances to a step S25 if the prescribed time has lapsed.

At the step S25, the control portion 7 controls the display portion 105 (see FIG. 1) to display an error code, thereby posting the error to the user. The control portion 7 advances to the step S25 when coins are left on the coin conveying paths of the paid coin conveying portion 5 and the temporary holding portion 2 due to jamming of the coins or the like, for example. When the display portion 105 displays the error code, the control portion 7 terminates the overflow control not properly but in an abnormal state.

At the step S26, the control portion 7 collectively subtracts the numbers of coins contained in the coin container 4 (41 to 46) having delivered the coins and further collectively adds the total number of coins discharged to the first coin outlet 102. Then, the control portion 7 terminates the overflow control.

(Discharge Processing Per Type)

At a step S31, the control portion 7 controls any one of the coin containers 41 to 46 in the near-full state or the full state (containing coins in a number of at least the prescribed number) to deliver the number of coins decided at the aforementioned step S3, as shown in FIG. 6. More specifically, the control portion 7 first controls only the 1-yen coin container 41 to deliver 1-yen coins when the 1-yen and 10-yen coin containers 41 and 45 are both in the near-full states or the full states (containing coins in numbers of at least the prescribed number), for example. Then, the control portion 7 advances to a step S32.

At the step S32, the control portion 7 sets a prescribed time required for discharging coins after delivering the same. The prescribed time at least includes a time generally required for delivering coins of a single type and discharging all coins delivered to the first coin outlet 102 and an allowance time for vacancy definition of the conveying path. During this prescribed time, the control portion 7 continuously drives the mechanisms of the paid coin conveying portion 5 and the temporary holding portion 2 for conveying coins. After setting the prescribed time, the control portion 7 advances to a step S33. The control portion 7 resets the prescribed time every time the discharged coin counting sensor 83 counts one coin.

At the step S33, the control portion 7 determines whether or not the discharged coin counting sensor 83 has sensed a single coin within a prescribed time after delivery of coins. The control portion 7 advances to a step S34 if the discharged coin counting sensor 83 has sensed a single coin within the prescribed time, while the same advances to a step S37 if the discharged coin counting sensor 83 has not sensed a single coin within the prescribed time. At the step S37, the control portion 7 performs processing (terminating the overflow control in an abnormal state after posting an error) similar to that at the aforementioned step S25, and hence description of this step is omitted.

At the step S34, the control portion 7 subtracts one from the number of coins of the delivered type contained in the coin container 4 (any of 41 to 46), and adds one to the total number of coins discharged to the first coin outlet 102. Then, the control portion 7 advances to a step S35.

At the step S35, the control portion 7 determines whether or not the total number of delivered coins counted by the delivered coin counting sensors 82*a* to 82*f* and the total number of discharged coins counted by the discharged coin counting sensor 83 coincide with each other. The control portion 7 advances to a step S36 if the total number of delivered coins and the total number of discharged coins coincide with each other, while the same returns to the step S33 if the total numbers do not coincide with each other. More specifically, the total number of delivered coins reaches one when the total number of delivered coins is 10 and the control portion 7 first performs the processing of the steps S33 to S35 in the overflow control, for example. Therefore, the control portion 7 repeats the steps S33 to S35 (10 times in total) until the total number of discharged coins reaches 10.

At the step S36, the control portion 7 determines whether or not there is another type of coins in the near-full state. The control portion 7 terminates the overflow control if there is no other type of coins in the near-full state, while the same returns to the step S31 if there is another type of coins in the near-full state.

More specifically, it is assumed that the 1-yen and 10-yen coin containers 41 and 45 are both in the near-full states, for example. In this case, the control portion 7 first performs 1-yen coin delivery processing, discharge processing to the first coin outlet 102 and adjustment processing (management) of the number of coins contained in the 1-yen coin container 41 and the total number of coins discharged to the first coin outlet 102 at the steps S31 to S35, and thereafter advances to the step S36. Then, the control portion 7 returns to the step S31, and performs similar processing (steps S31 to S35) also on the 10-yen coin container 45.

When the lid portion 106 is opened and coins stored in the first coin outlet 102 are removed, the residual coin sensor 84 senses that there are no coins remaining in the first coin outlet 102. Then, the control portion 7 resets the total number of discharged coins in the first coin outlet 102 to zero.

(Another Use Mode of Coin Processor)

Another use mode of the coin processor 100 is now described with reference to FIG. 2.

The coin processor 100 is configured to be switchable to another use mode performing no overflow control by switching the mode of software driven by the control portion 7. In another use mode, the first coin outlet 102 functions as an outlet for coins for refund payment and coins discharged by the overflow control, and the second coin outlet 103 functions as an outlet for coins for change.

More specifically, the control portion 7 is configured to temporarily hold coins received from the coin inlet 102 in the temporary holding portion 2 when switched to another use mode and to refund the coins held in the temporary holding portion 2 as such from the first coin outlet 102 when receiving a signal for refund payment (cancellation). In other words, the first coin outlet 102 is configured to be employable at least for discharging coins for refund payment.

Further, the control portion 7 is configured to perform control of delivering coins for change from the coin container 4 and discharging the same to the second coin outlet 103 for discharging coins for refund payment. In addition, the control portion 7 is configured to perform control of discharging coins determined by the coin checking portion 1*a* as not in specie to the second coin outlet 103. In other words, the control portion 7 performs control of employing the first coin outlet 102 as a dedicated refunding port for refunding received coins as such. The second coin outlet 103 is configured to be employable at least for discharging coins for change.

(Effects of First Embodiment)

According to the first embodiment, the following effects can be attained:

According to the first embodiment, the aforementioned control portion 7 is so provided that the same can discharge, while controlling, coins reaching at least the prescribed number substantially filling up the coin container 4 from the coin container 4 to the existing first coin outlet 102 employable for discharging coins for refund payment. Consequently, the coin processor 100 can perform the overflow control with the existing structure without complicating the device structure, dissimilarly to a case of providing a dedicated (essential) structure for the overflow control.

According to the first embodiment, as hereinabove described, the control portion 7 is configured to perform the overflow control of discharging coins of the type reaching at least the prescribed number from the coin container 4 to the first coin outlet 102 and the control of discharging coins for refund payment and those for change to the second coin outlet 103. Thus, coins discharged through the overflow control and those for refund payment and for change are discharged to coin outlets different from each other, whereby the coins can be prevented from mixing up each other. Consequently, labor for removing coins for refund payment or those for change from the coin outlet can be omitted before discharging these coins. Further, labor for removing coins discharged through the overflow control from the coin outlet can be omitted before discharging coins for refund payment and those for change.

According to the first embodiment, as hereinabove described, the coin processor 100 is provided with the discharged coin counting sensor 83 for counting the number of coins discharged to the first coin outlet 102, and the control portion 7 is configured to perform control of managing the total number of discharged coins indicating the sum of the number of coins discharged to the first coin outlet 102 every overflow control on the basis of the number of coins delivered from the coin container 4 and the number of discharged coins counted by the discharged coin counting sensor 83 when performing the overflow control. The total number of discharged coins indicates the total number of coins stored in the first coin outlet 102 through the overflow control, and the control portion 7 calculates the same by adding up the numbers of coins discharged to the first coin outlet 102 every overflow control. For example, it is assumed that the number of coins stored in the first coin outlet 102 of the coin processor 100 is zero. If the numbers of discharged coins are 10 and 20 in first overflow control and second overflow control respectively, the total number of discharged coins (the number of coins stored in the first coin outlet 102) is 30. According to the aforementioned structure, the first coin outlet 102 can be prevented from being filled up (or overflown) with discharged coins on the basis of the total number of discharged coins and the maximum number (capacity) of coins containable in the existing first coin outlet 102.

According to the first embodiment, as hereinabove described, the coin processor 100 is provided with the delivered coin counting sensors 82*a* to 82*f* for counting the numbers of coins of the respective types delivered from the coin container 4, and the control portion 7 is configured to perform control of delivering coins of the type reaching at least the prescribed number from the coin container 4 per type when performing the overflow control and to perform control of subtracting one from the number of coins of the corresponding type contained in the coin container 4, adding one to the total number of coins discharged to the first coin outlet 102 and confirming whether or not the total number of delivered coins counted by the delivered coin counting sensors 82*a* to 82*f* and the total number of discharged coins counted by the discharged coin counting sensor 83 coincide with each other every time the discharged coin counting sensor 83 counts a single coin. The total number of delivered coins indicates the sum of coins delivered from the coin container 4 through single overflow control, and the total number of discharged coins indicates the sum of coins discharged to the first coin outlet 102 through single overflow control. According to the aforementioned structure, the discharged coin counting sensor 83 can count coins of a single type one by one, whereby the control portion 7 can more correctly perform the overflow control. Further, the control portion 7 can secure precision (correctness) of the total number of delivered coins and the total number of discharged coins by confirming the coincidence therebetween.

According to this embodiment, as hereinabove described, the coin processor 100 is provided with the delivered coin counting sensors 82*a* to 82*f* counting the numbers of coins of the respective types delivered from the coin container 4, and the control portion 7 is configured to perform control of collectively delivering coins of a plurality of types reaching at least the prescribed number from the coin container 4 to the first coin outlet 102 when performing the overflow control if the coins of the plurality of types reach at least the prescribed number and to perform control of collectively decreasing the numbers of coins of the delivered types contained in the coin container 4 and collectively adding up the total numbers of coins discharged to the first coin outlet 102 when the total number of delivered coins counted by the delivered coin counting sensors 82*a* to 82*f* and the total number of discharged coins counted by the discharged coin counting sensor 83 coincide with each other. Thus, the numbers of coins of a plurality of types can be collectively counted, whereby the control portion 7 can more quickly perform the overflow control. Further, the control portion 7 can secure precision (correctness) of the total number of delivered coins and the total number of discharged coins by determining the coincidence therebetween.

According to the first embodiment, as hereinabove described, the coin processor 100 is provided with the residual coin sensor 84 sensing the presence or absence of coins remaining in the first coin outlet 102 receiving coins of the type reaching at least the prescribed number, for resetting the total number of coins discharged to the first coin outlet 102 and counted by the discharged coin counting sensor 83 to zero when the residual coin sensor 84 senses the absence of coins remaining in the first coin outlet 102. Thus, the coin processor 100 can reset the total number of discharged coins counted by the discharged coin counting sensor 83 to zero with the residual coin sensor 84, whereby the coin processor 100 can correctly manage the total number of discharged coins also when the coins discharged to (stored in) the first coin outlet 102 are removed.

According to the first embodiment, as hereinabove described, the control portion 7 is configured to perform control of discharging coins of a prescribed type in number exceeding the upper limit to the other one of the first and second coin outlets 102 and 103 without through the coin container 4 when receiving the coins in number exceeding the upper limit of coins containable in the coin container 4. Thus, the coins exceeding the upper limit can be discharged to the second coin outlet 103 without through the coin container 4, whereby the coin processor 100 can avoid an error caused by receiving coins uncontainable in the coin container 4. When coins received from the coin inlet 101 and uncontainable in the coin container 4 are present on the coin conveying path employed in the overflow control, the coin processor 100 can prevent the coins discharged through the overflow control and those received but uncontainable in the coin container 4 from mixing up with each other on the conveying path.

According to the first embodiment, as hereinabove described, the mountable lid portion 106 is provided on the first coin outlet 102 discharging coins of the type reaching at least the prescribed number. Thus, the coin processor 100 can prevent a person other than the one having prescribed authority from extracting the coins discharged through the overflow control by mounting the lid portion 106. Further, the lid portion 106 can prevent coins from overflowing the first coin outlet 102.

According to the first embodiment, as hereinabove described, the coin processor 100 is configured to close the lid portion 106 in the use state where the customer makes account and to open or demount the lid portion 106 in the use state where the distributor makes account. Thus, the coin processor 100 can prevent a person other than the one having prescribed authority from extracting coins in the use state (so-called self accounting state) where the customer makes account. Further, the distributor can easily extract coins from the first coin outlet 102 by demounting (or opening) the lid portion 106 in the use state where the distributor makes account.

According to the first embodiment, as hereinabove described, the coin processor 100 further includes the coin checking portion 1*a* determining the type of coins received in the coin inlet 101 and whether or not the coins are in specie, and the control portion 7 is configured to perform control of discharging coins determined by the coin checking portion 1*a* as not in specie to the other one of the first and second coin outlets 102 and 103 when performing the overflow control of discharging coins of the type reaching at least the prescribed number from the coin container 4 to the first coin outlet 102. Thus, the control portion 7 can discharge coins (medium) not in specie to the other one of the first and second coin outlets 102 and 103, whereby the same can prevent the coins (medium) not in specie and coins discharged through the overflow control from mixing with each other.

According to the first embodiment, as hereinabove described, the coin processor 100 is provided with the temporary holding portion 2 temporarily holding coins received from the coin inlet 102 and conveying the same to the sorting portion 3 or the first coin outlet 102, the contained coin switching gate 2*a* provided on the temporary holding portion 2 for switching the coin conveyance destination path to either the sorting portion 3 or the first coin outlet 102, the paid coin conveying portion 5 conveying coins delivered from the coin container 4 to the second coin outlet 103 or the temporary holding portion 2 and the paid coin switching gate 5*a* provided on the paid coin conveying portion 5 for switching the coin conveyance destination path to either the second coin outlet 103 or the temporary holding portion 2, and the control portion 7 is configured to perform control of switching the coin conveyance destination path to the temporary holding portion 2 with the paid coin switching gate 5*a*, switching the coin conveyance destination path to the first coin outlet 102 with the contained coin switching gate 2*a* and discharging coins of the type reaching at least the prescribed number from the coin container 4 to the first coin outlet 102 through the paid coin conveying portion 5 and the temporary holding portion 2. Thus, the coin processor 100 can ensure the conveying path for coins discharged through the overflow control with the temporary holding portion 2, the contained coin switching gate 2*a*, the paid coin conveying portion 5 and the paid coin switching gate 5*a*. Further, the coin processor 100 can convert the existing contained coin switching gate 2*a* and the existing temporary holding portion 2 employed for introducing coins into the coin container 4 as well as the existing paid coin conveying portion 5 and the existing paid coin switching gate 5*a* employed for delivering coins from the coin container 4 as the conveying path for coins discharged through the overflow control, whereby the device structure can be prevented from complication.

Second Embodiment

Figure 7:
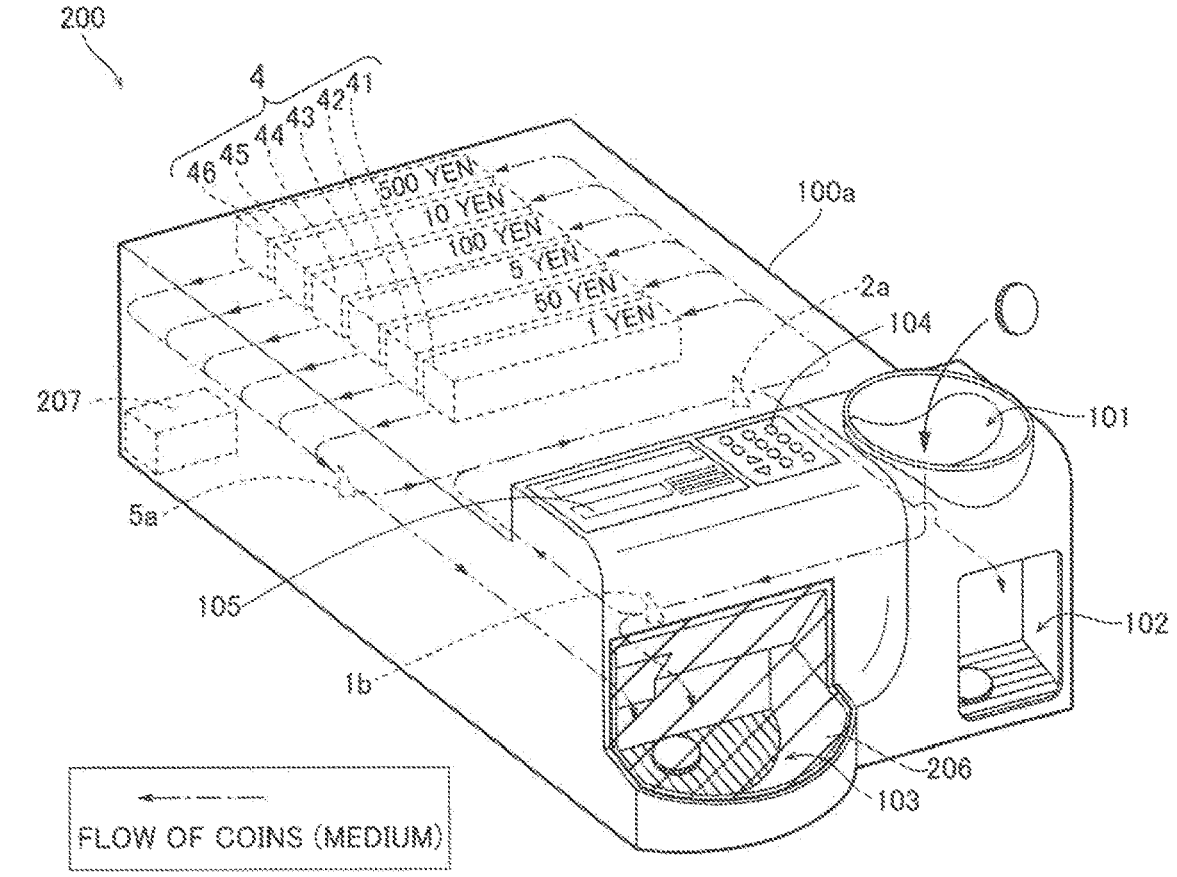
FIG. 7 is a perspective view showing a coin processor according to a second embodiment of the present invention.

A second embodiment of the present invention is now described with reference to FIGS. 2, 3 and 7. According to the second embodiment, a control portion 207 discharges coins delivered from a coin container 4 to a second coin outlet 103 through overflow control, dissimilarly to the aforementioned first embodiment having the control portion 7 discharging coins delivered from the coin container 4 to the first coin outlet 102 through the overflow control. Referring to FIG. 7, portions similar in structure to those in the aforementioned first embodiment are denoted by the same reference signs.

A coin processor 200 according to the second embodiment of the present invention includes the control portion 207, as shown in FIG. 7. According to the second embodiment, a mountable lid portion 206 (see a hatched portion in FIG. 7) is provided on the second coin outlet 103, dissimilarly to the aforementioned first embodiment. The lid portion 206 is provided with a key or the like, and configured to be openable/closable only by a specific person such as a distributor.

The control portion 207 shown in FIGS. 2 and 3 is configured to perform overflow control of discharging coins of a prescribed type reaching at least a prescribed number substantially filling up a coin container 4 (any of 41 to 46) from the coin container 4 to the second coin outlet 103 when the number of the corresponding coins contained in the coin container 4 reaches at least the prescribed number. In other words, the second coin outlet 103 functions as an outlet for coins discharged through the overflow control. A first coin outlet 102 functions as an outlet for coins for change and those for refund payment.

More specifically, the control portion 207 is configured to perform control of switching a coin conveyance destination path to the second coin outlet 103 with a paid coin switching gate 5*a* and to discharge coins of the type reaching at least the prescribed number from the coin container 4 to the first coin outlet 102 through a paid coin conveying portion 5 when performing the overflow control. In other words, the coin processor 200 according to the second embodiment does not employ a temporary holding portion 2 for conveying coins when performing the overflow control.

Further, the control portion 207 is configured to perform control of delivering coins for change from the coin container 4 and discharging (sending) the same to the first coin outlet 102. In other words, the control portion 207 performs control of discharging the coins for change to a coin outlet different from the second coin outlet 103 discharging coins through the overflow control.

More specifically, the control portion 207 performs control of switching the conveyance destination path for the coins delivered from the coin container 4 to the temporary holding portion 2 with the paid coin switching gate 5*a*, switching the conveyance destination path for the coins delivered from the coin container 4 to the temporary holding portion 2 with a contained coin switching gate 2*a*, delivering coins for change from the coin container 4 and discharging the same to the first coin outlet 102 through the paid coin conveying portion 5 and the temporary holding portion 2.

In addition, the control portion 207 is configured to perform control of discharging (refunding) the coins for refund payment as such from the temporary holding portion 2 to the first coin outlet 102 without through the coin container 4. In other words, the control portion 207 performs control of discharging the coins for refund payment to a coin outlet different from the second coin outlet 103 discharging coins through the overflow control.

More specifically, the control portion 207 performs control of switching the coin conveyance destination path to the first coin outlet 102 with the contained coin switching gate 2*a* and discharging the coins temporarily held in the temporary holding portion 2 to the first coin outlet 102 as those for refund payment.

The remaining structure of the second embodiment is similar to that of the aforementioned first embodiment.

(Effects of Second Embodiment)

According to the second embodiment, the following effects can be attained:

According to the second embodiment, the coin processor 200 is provided with the aforementioned control portion 207 similarly to the aforementioned first embodiment, whereby the same can perform the overflow control with an existing structure without complicating the device structure.

According to the second embodiment, as hereinabove described, the control portion 207 is configured to perform control of delivering coins from the coin container 4 and discharging the same from the second coin outlet 103 while discharging coins for refund payment held in the temporary holding portion 2 from the first coin outlet 102 when performing the overflow control. Thus, the control portion 207 can perform the overflow control of discharging coins to the second coin outlet 103, and can refund received coins themselves to the first coin outlet 102.

The remaining effects of the second embodiment are similar to those of the aforementioned first embodiment.

MODIFICATIONS

The embodiments disclosed this time must be considered as illustrative in all points and not restrictive. The range of the present invention is shown not by the description of the aforementioned embodiments but by the scope of claims for patent, and all alterations (modifications) within the meaning and range equivalent to the scope of claims for patent are included.

Figure 8:
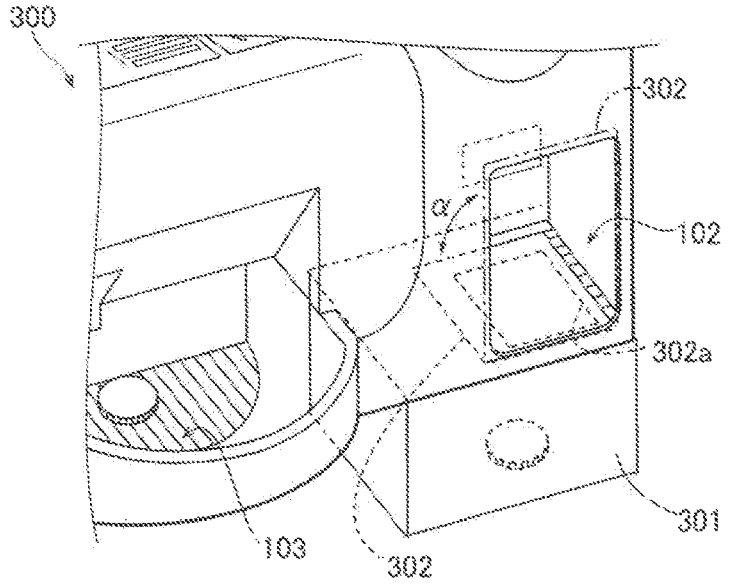
FIG. 8 is a perspective view showing a first coin outlet, a reservation portion and an introduction gate of a coin processor according to a modification of the first embodiment of the present invention.

For example, while the coin processor is configured to store coins discharged through the overflow control in the first coin outlet in the aforementioned first embodiment, the present invention is not restricted to this. According to the present invention, a coin processor 300 can store coins discharged through overflow control in a reservation portion 301 mounted on a first coin outlet 102, as shown in FIG. 8.

The coin processor 300 includes the reservation portion 301, an introduction gate 302 having an introduction hole 302*a* vertically passing therethrough and a control portion 307, in addition to a structure similar to that of the coin processor 100 according to the first embodiment. A through-hole (not shown) is provided on the lower end of the first coin outlet 102. The introduction gate 302 is configured to be mountable on the lower end of the first coin outlet 102 to block the through-hole provided on the lower end of the first coin outlet 102 and to be openable/closable. Further, the introduction gate 302 has a hinge portion (not shown), and is configured to be opened for moving frontward (along arrow a) thereby blocking a front opening of the first coin outlet 102 (on this side of the coin processor 300). When the introduction gate 302 is opened, therefore, coins cannot be extracted from inside the first coin outlet 102. The reservation portion 301 is provided in the form of a box, and configured to be mountable on the first coin outlet 102 from below the introduction gate 302, for receiving coins of a prescribed type reaching at least a prescribed number through the first coin outlet 102 and the introduction hole 302*a* and reserving the same therein when the introduction gate 302 is opened. The control portion 307 is configured to perform control of discharging coins for refund payment to the first coin outlet 102 when the introduction gate 302 is closed while discharging coins of the type reaching at least the prescribed number into the reservation portion 301 through the first coin outlet 102 and reserving the same in the reservation portion 301 when the introduction gate 302 is opened. Thus, the reservation portion 301 can reserve a larger number of coins on the side of the first coin outlet 102. Further, the control portion 307 can prevent coins for refund payment and those discharged through the overflow control from mixing with each other by opening/closing the introduction gate 302.

While the coin processor is configured to be capable of storing coins of the Japanese currency in each of the aforementioned first and second embodiments, the present invention is not restricted to this. According to the present invention, the coin processor may alternatively be configured to be capable of storing coins of currency other than the Japanese currency.

While the control portion is configured to perform the control of discharging coins for refund payment to the second coin outlet when performing the overflow control in the aforementioned first embodiment, the present invention is not restricted to this. According to the present invention, the control portion may alternatively be configured to perform control of discharging coins for refund payment to the first coin outlet when performing the overflow control.

While the control portion is configured to calculate the total number of discharged coins by adding up the numbers of coins discharged every overflow control with the discharged coin counting sensor in each of the aforementioned first and second embodiments, the present invention is not restricted to this. According to the present invention, the first coin outlet (second coin outlet) may alternatively be provided not with the residual coin sensor but with a weight sensor or an image sensor, for directly counting the number of discharged coins.

While the coin processor includes the temporary holding portion in each of the aforementioned first and second embodiments, the present invention is not restricted to this. According to the present invention, the coin processor may alternatively include no temporary holding portion.

While the control portion is configured to manage the total number of coins discharged to the first coin outlet (second coin outlet) and the number of coins contained in the coin container on the basis of the number of coins delivered from the coin container and the number of coins discharged to the first coin outlet (second coin outlet) in each of the aforementioned first and second embodiments, the present invention is not restricted to this. According to the present invention, the control portion may alternatively be configured to manage the total number of coins discharged to the first coin outlet (second coin outlet) and the number of coins contained in the coin container not on the basis of the number of coins discharged to the first coin outlet (second coin outlet) but on the basis of the number of coins delivered from the coin container.

While the control portion is configured to perform the control of discharging the coins for refund payment to the first coin outlet when performing the overflow control in the aforementioned second embodiment, the present invention is not restricted to this. According to the present invention, the control portion may alternatively be configured to perform control of discharging coins for refund payment to the second coin outlet when performing the overflow control.

While the control processing of the control portion related to the coin processor has been described with the "flow-driven type" flow chart successively performing processing along a processing flow for the convenience of illustration in each of the aforementioned first and second embodiments, the present invention is not restricted to this. According to the present invention, the control portion may alternatively perform processing through "event-driven type" processing executing processing in the units of events. In this case, the control portion may perform the processing as a complete event-driven type one, or in a combination of event-driven and flow-driven processes.

What is claimed is:

1. A coin processor comprising;

a sorting portion sorting coins received from a coin inlet according to a plurality of types of coins;

coin containers containing the coins sorted through the sorting portion according to the plurality of types of coins;

a first coin outlet employable at least for discharging coins for refund payment;

a second coin outlet employable at least for discharging coins for change;

a control portion performing overflow control of discharging overflow coins to one of the first coin outlet and the second coin outlet when coins of a prescribed type reach at least a prescribed number to substantially fill up one of the coin containers; and a coin checking portion determining a type of each of coins received in the coin inlet and whether or not the coins received in the coin inlet are fake coins, when performing discharging operation of discharging the overflow coins;

an openable/closable introduction gate having an introduction hole and configured to be mountable on a lower end of the first coin outlet, and a box-type reservation portion configured to be mountable on the first coin outlet from below the introduction gate for receiving coins reaching at least the prescribed number and reserving the coins therein through the first coin outlet and the introduction hole when the introduction gate is in an open state, wherein the control portion is configured to perform control of discharging a coin for refund oavment to the first coin outlet in a state where the introduction gate is closed while discharging coins reaching at least the prescribed number into the reservation portion through the first coin outlet and reserving the coins in the reservation portion in a state where the introduction gate is opened.

2. The coin processor according to claim 1, wherein the control portion is configured to perform discharging operation of discharging the coins of the type reaching at least the prescribed number from the coin container to one of the first coin outlet and the second coin outlet and to perform control of discharging coins for refund payment and coins for change to the other of the first coin outlet and the second coin outlet.

3. The coin processor according to claim 1, further comprising a discharged coin counting sensor counting a number of coins discharged to one of the first coin outlet and the second coin outlet, wherein the control portion is configured to perform control of managing a total number of discharged coins indicating a sum of the number of coins discharged to one of the first coin outlet and the second coin outlet at every discharging operation on a basis of the number of coins delivered from one of the coin containers and the number of discharged coins counted by the discharged coin counting sensor when performing the discharging operation.

4. The coin processor according to claim 3, further comprising a delivered coin counting sensor counting a number of coins delivered from one of the coin containers, wherein the control portion is configured to perform control of delivering coins reaching at least the prescribed number from one of the coin containers when performing the discharging operation, and to perform control of subtracting one from the number of coins contained in one of the coin containers and adding one to a total number of coins discharged to one of the first coin outlet and the second coin outlet while confirming whether or not a total number of delivered coins counted by the delivered coin counting sensor and a total number of discharged coins counted by the discharged coin counting sensor coincide with each other every time when the discharged coin counting sensor counts a single coin.

5. The coin processor according to claim 3, further comprising delivered coin counting sensors counting a number of coins delivered from the coin containers according to the plurality of types thereof, wherein the control portion is configured to perform control of collectively delivering coins of the plurality of types reaching at least the prescribed number from the coin containers to one of the first coin outlet and the second coin outlet if the plurality of types of coins reaches the prescribed number when performing the discharging operation, and to perform control of collectively decreasing the number of coins of the plurality of types delivered from the coin containers and collectively increasing a total number of coins discharged to one of the first coin outlet and the second coin outlet when a total number of delivered coins counted by the delivered coin counting sensor and the total number of discharged coins counted by the discharged coin counting sensor coincide with each other.

6. The coin processor according to claim 4, further comprising a residual coin sensor sensing presence or absence of coins remaining in one of the first coin outlet and the second coin outlet receiving the coins of the type reaching at least the prescribed number, for resetting the total number of discharged coins discharged to one of the first coin outlet and the second coin outlet and counted by the discharged coin counting sensor to zero when the residual coin sensor senses absence of coins remaining in one of the first coin outlet and the second coin outlet.

7. The coin processor according to claim 1, wherein the control portion is configured to perform control of discharging coins exceeding an upper limit of coins of the prescribed type containable in one of the coin containers to the other of the first coin outlet and the second coin outlet without passing through the coin container when receiving coins in excess of the upper limit.

8. The coin processor according to claim 1, further comprising a mountable lid portion on one of the first coin outlet and the second coin outlet receiving the coins of the type reaching at least the prescribed number.

9. The coin processor according to claim 8, wherein the lid portion is configured to be closed in a use state where a customer counts money and is configured to be opened or demounted in a use state where a distributor counts money.

10. The coin processor according to claim 1, wherein the control portion is configured to perform control of discharging coins determined through the coin checking portion as fake coins to the other of the first coin outlet and the second coin outlet if the coin checking portion determines that the received coins are fake coins when performing the discharging operation of discharging coins reaching at least the prescribed number from one of the coin containers to one of the first coin outlet and the second coin outlet.

11. The coin processor according to claim 1, further comprising:

a temporary holding portion temporarily holding a coin received from the coin inlet and conveying the coin to the sorting portion or the first coin outlet, a contained coin switching gate provided on the temporary holding portion for switching a coin conveyance destination path to either the sorting portion or the first coin outlet, a paid coin conveying portion conveying a coin delivered from one of the coin containers to the second coin outlet or the temporary holding portion, and a paid coin switching gate provided on the paid coin conveying portion for switching a coin conveyance destination path to either the second coin outlet or the temporary holding portion, wherein the control portion is configured to perform control of switching the coin conveyance destination path to the temporary holding portion with the paid coin switching gate, switching the coin conveyance destination path to the first coin outlet with the contained coin switching gate and discharging the coins reaching at least the prescribed number from one of the coin containers to the first coin outlet through the paid coin conveying portion and the temporary holding portion when performing the discharging operation.

12. The coin processor according to claim 1, wherein the first coin outlet is employable for discharging the overflow coins when the coins of the prescribed type reach at least the prescribed number to substantially fill up one of the coin containers, and the coin checking portion determines a type of the coins received in the coin inlet during the discharging operation and whether or not the other coins received in the coin inlet during the discharging operation are fake coins simultaneously while discharging the overflow coins to the first coin outlet.

13. The coin processor according to claim 12, wherein the control portion is configured to perform control of discharging the coins received in the coin inlet during the discharging operation to the second coin outlet if the coin checking portion determines that the coins are fake, to prevent fake coins from mixing with the overflow coins.

14. The coin processor according to claim 1, wherein the openable/closable introduction gate includes a hinge portion, and the control portion is configured to perform control of turning the openable/closable introduction gate around the hinge portion, when the coins reaching at least the prescribed number are discharged into the reservation portion through the first coin outlet, such that a front opening of the first coin outlet is closed and the coins discharged into the reservation portion is not extracted from the first coin outlet.

* * * * *